US005375763A

United States Patent [19]

Sauerwine

[11] Patent Number: 5,375,763

[45] Date of Patent: Dec. 27, 1994

[54] V-FOLD TWO-PLY MAILER

[75] Inventor: Dean N. Sauerwine, Emmaus, Pa.

[73] Assignee: Moore Business Forms, Inc., Grand Island, N.Y.

[21] Appl. No.: 89,329

[22] Filed: Jul. 12, 1993

[51] Int. Cl.[5] ..... B65D 27/04; B65D 27/06

[52] U.S. Cl. ..... 229/303; 229/304; 229/305

[58] Field of Search ..... 229/71, 300, 301, 303, 229/304, 305, 92.1, 92.3

[56] References Cited

U.S. PATENT DOCUMENTS

| | | | |
|---|---|---|---|
| 786,436 | 4/1905 | Goodman . | |
| 2,299,751 | 10/1942 | Huffman . | |
| 3,152,751 | 10/1964 | Hiersteiner . | |
| 3,507,444 | 4/1970 | Werby . | |
| 3,552,641 | 1/1971 | Bell et al. | 229/305 X |
| 3,837,565 | 9/1974 | Johnsen . | |
| 4,102,489 | 7/1978 | Lucas . | |
| 4,375,868 | 3/1983 | Slotar et al. . | |
| 4,435,001 | 3/1984 | Mills et al. | 229/301 X |
| 4,706,877 | 11/1987 | Jenkins . | |
| 4,715,531 | 12/1987 | Stewart et al. . | |
| 4,729,506 | 3/1988 | Neubauer | 229/71 X |
| 4,744,508 | 5/1988 | Fowler et al. | 229/301 |
| 4,784,317 | 11/1988 | Chen et al. . | |
| 4,898,323 | 2/1990 | Chen et al. . | |
| 4,927,072 | 5/1990 | Jenkins et al. . | |
| 5,024,374 | 6/1991 | Ashby | 229/305 X |
| 5,238,182 | 8/1993 | Loch | 229/304 |
| 5,253,803 | 10/1993 | Chess | 229/305 |

*Primary Examiner*—Allan N. Shoap
*Assistant Examiner*—Jes F. Pascua
*Attorney, Agent, or Firm*—Nixon & Vanderhye

[57] ABSTRACT

An intermediate for a mailer type business form, and the mailer so produced, comprise face-to-face first and second plies which have aligned windows in them, with the outgoing address visible through both windows in the outgoing configuration of the mailer, and with the reply address visible through the second window in the reply envelope configuration after the outgoing mailer is opened and a reply address card inserted into the reply envelope. Carbonless coatings are also preferably provided associated with the first and second plies so that indicia imprinted on the first ply is transferred to the second ply. First adhesive patterns hold the plies together in the intermediate, and second adhesive patterns hold the mailer together when the plies are V-folded about aligned intermediate fold lines. Perforations allow opening of the outgoing mailer, and the bottommost ply of the outgoing mailer has reply address indicia printed thereon, and perforations which allow it to be detached into a card and inserted into the reply envelope, for reply address indicia visible through the second window.

23 Claims, 6 Drawing Sheets

FIG. 8
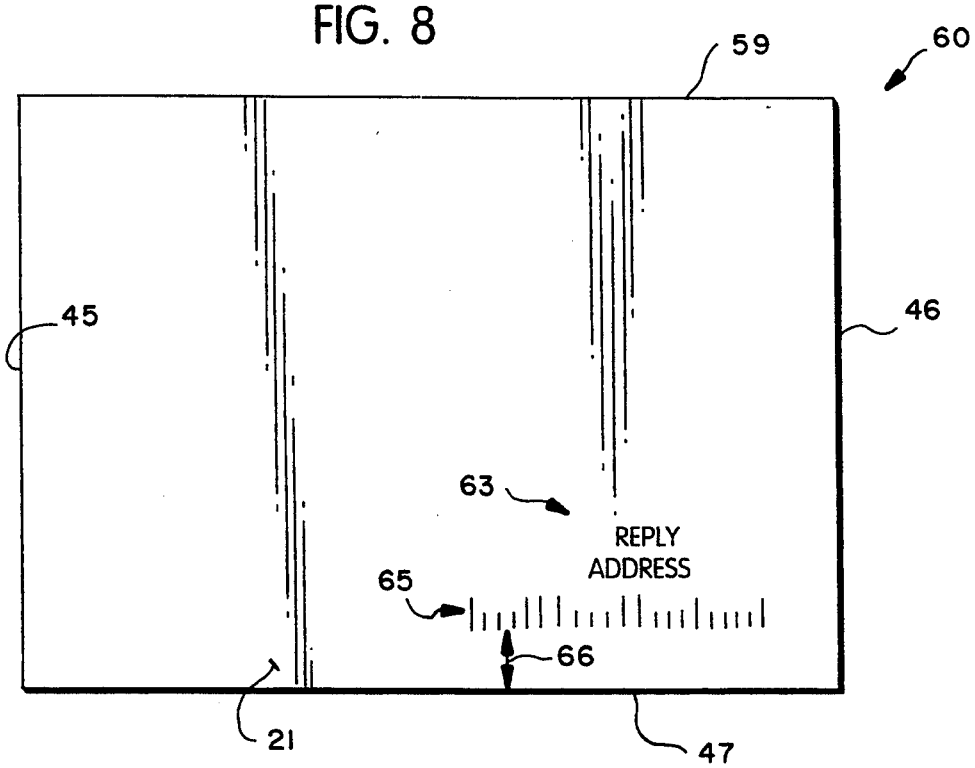
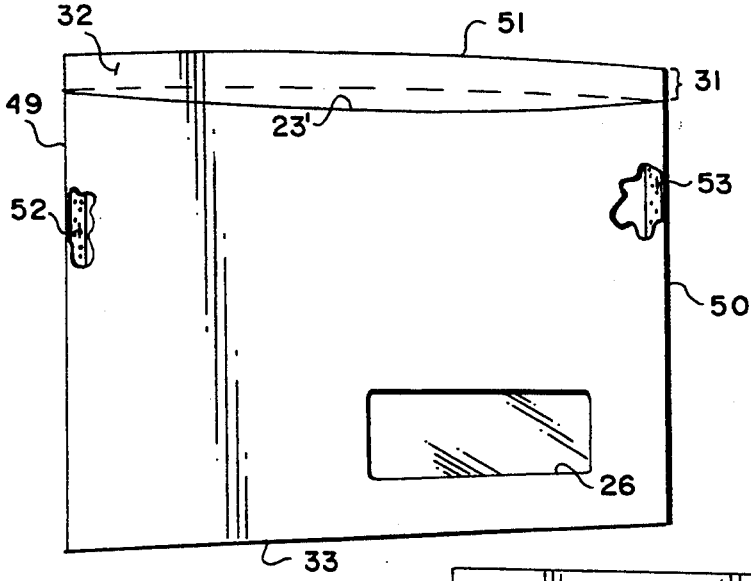
FIG. 9
FIG. 10
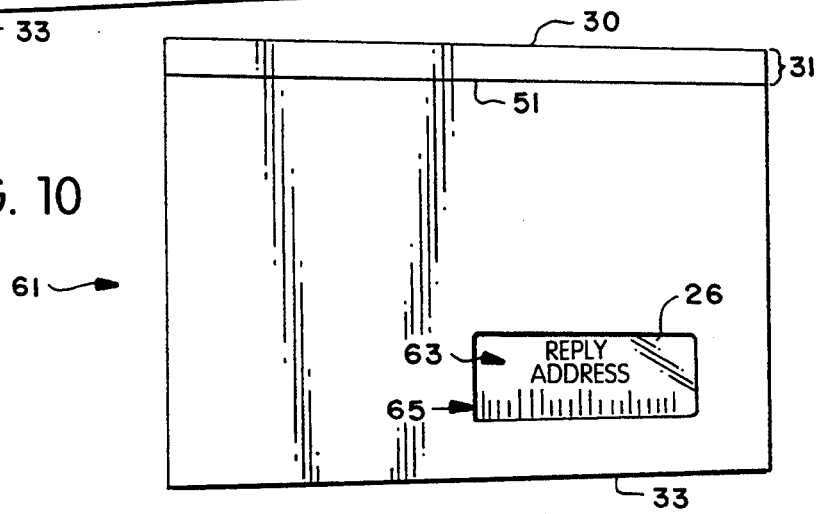

V-FOLD TWO-PLY MAILER

BACKGROUND AND SUMMARY OF THE INVENTION

In the construction of mailer type business forms, which are some of the most versatile and useful business forms, sometimes it is desirable to provide indicia imprinted onto a top ply to an underlying ply, and also to provide a return envelope construction that is simple to utilize. However, since an outer face of the outgoing envelope will have a carbonless coating on it, it is desirable to provide a window in that face so that a reply address card having a reply address on it is visible through the window in the reply envelope.

According to a first aspect of the present invention, an intermediate for a mailer type business form is provided which comprises the following elements: A first ply having first length and first width dimensions, perimeter edges, first and second faces, and a first window therein. A first fold line formed in the first ply across the width thereof. A second ply having second length and second width dimensions both less than the first length and width dimensions, perimeter edges, first and second faces, and a second window therein. A second fold line formed in the second ply across the width thereof. First adhesive patterns for attaching the first and second plies together adjacent at least some of the perimeter edges of the second ply, so that the first and second windows are aligned and so that the first and second fold lines are aligned and so that the second ply covers the majority of the first face of the first ply, the second ply second face substantially in face-to-face engagement with the first ply first face. Second adhesive patterns provided adjacent at least some of the perimeter edges of the first face of the first ply on areas thereof uncovered by the second ply, for holding the first ply in an outgoing mailer configuration when folded about the first fold line. And, third adhesive patterns formed on the first face of the second ply for forming a reply envelope when the second ply is folded about the second fold line.

The second window in the intermediate is slightly larger than the first window, and when the windows are aligned no portion of the second ply immediately adjacent the second window is visible through the first window. A CB coating is provided on at least a significant portion of the second face of the second ply, and a CF coating on at least the portion of the first face of the first ply aligned with the CB coated portion of the second face of the second ply. The first adhesive means secures the second ply to the first ply at three perimeter edges of the second ply, but not at a fourth perimeter edge. Lines of weakness are provided which allow the mailer formed from the intermediate to be readily opened despite the adhesive patterns.

The first fold line is typically provided at a mid point of the length of the first ply, so that the intermediate is V-folded to form a mailer according to the invention. An outgoing address area is provided on the first face of the second ply on the opposite side of the second fold line from the second window, aligned with the second window when the intermediate is V-folded about the fold lines. Reply address indicia is typically provided on the first ply on the panel thereof on the opposite side of the first fold line from the first window, and perforations are formed in the first ply to allow a sheet portion with the reply address thereon to be detached from the first ply and inserted into a reply envelope formed from the second ply so that it is visible through the second window. The second ply also has a flap formed therein with activatable adhesive on the first face of the second ply, at the flap.

According to another aspect of the present invention an intermediate for a mailer type business form is provided comprising the following elements: A first ply having first length and width dimensions, perimeter edges, and first and second faces. A first fold line formed in the first ply across the width thereof at approximately the mid point of the length. A second ply having second length and width dimensions both less than the first length and width dimensions, perimeter edges, and first and second faces. A second fold line formed in the second ply across the width thereof. First adhesive patterns for attaching the first and second plies together adjacent at least some of the perimeter edges of the second ply, so that the first and second fold lines are aligned and so that the second ply covers the majority of the first face of the first ply, the second ply second face substantially in face-to-face engagement with the first ply first face. Second adhesive patterns provided adjacent at least some of the perimeter edges of the first face of the first ply on areas thereof uncovered by the second ply, for holding the first ply in an outgoing mailer configuration when folded about the first fold line. Third adhesive patterns formed on the first face of the second ply for forming a reply envelope when the second ply is folded about the second fold line. A CB coating on at least a significant portion of the second face of the second ply. And, a CF coating on a portion of the first face of the first ply aligned with the CB coated portion of the second face of the second ply.

The invention also comprises a mailer type business form. The mailer type business form comprises the following elements: A first ply having top and bottom faces and a first window therein. A second ply having top and bottom faces, the top face of the second ply in face-to-face engagement with the bottom face of the first ply, the second ply having a second window therein in alignment with the first window. A third ply having top and bottom faces underlying the second ply, the third ply top face in substantial face-to-face engagement with the second ply bottom face, and outgoing address information provided on the top face of the third ply in alignment with the first and second windows. A fourth ply having top and bottom faces, the top face of the fourth ply in substantial face-to-face engagement with the bottom face of the third ply. Adhesive patterns for holding the plies together to form an outgoing mailer configuration, and a reply envelope within the outgoing mailer configuration. And, lines of weakness adjacent the adhesive patterns for allowing opening of the outgoing mailer to expose the reply envelope.

The second window is slightly larger than the first window and the windows are aligned so that no portion of the second ply immediately adjacent the second window is visible through the first window. Also a CF coating is provided on the bottom face of the first ply, and a CB coating on the top face of the second ply. Reply address indicia is printed on the fourth ply, and perforations are formed on the fourth ply so that a reply address containing a portion of the fourth ply can be detached from the fourth ply and inserted in the reply envelope, so that the reply address is visible through the second window.

According to yet another aspect of the present invention a mailer type business form is provided comprising the following elements: A second ply having top and bottom faces, the top face of the second ply in face-to-face engagement with the bottom face of the first ply. A third ply having top and bottom faces underlying the second ply, the third ply top face in substantial face-to-face engagement with the second ply bottom face, and outgoing address information provided on the top face of the third ply in alignment. A fourth ply having top and bottom faces, the top face of the fourth ply in substantial face-to-face engagement with the bottom face of the third ply. Adhesive patterns for holding the plies together to form an outgoing mailer configuration, and a reply envelope within the outgoing mailer configuration. Lines of weakness adjacent the adhesive patterns for allowing opening of the outgoing mailer to expose the reply envelope. And, a CF coating on at least a significant portion of the bottom face of the first ply, and a CB coating on a portion of the top face of second ply aligned with the CF coated portion of the bottom face of the first ply.

It is the primary object of the present invention to provide a mailer type business form, and intermediate for the construction thereof, that is versatile and advantageous. This and other objects of the invention will become clear from an inspection of the detailed description of the invention, and from the appended claims.

BRIEF DESCRIPTION OF THE DRAWINGS

FIGS. 7 and 8 are top and bottom views, respectively, of a portion of the bottom ply of the mailer of FIGS. 5 and 6;

FIG. 9 is a top perspective view of an exemplary reply envelope formed from the mailer of FIGS. 5 and 6, open and ready to receive a reply address card therein; and FIG. 10 is a sealed version of the mailer of FIG. 9 after the reply card of FIGS. 7 and 8 has been inserted therein.

DETAILED DESCRIPTION OF THE DRAWINGS

Figure 1:
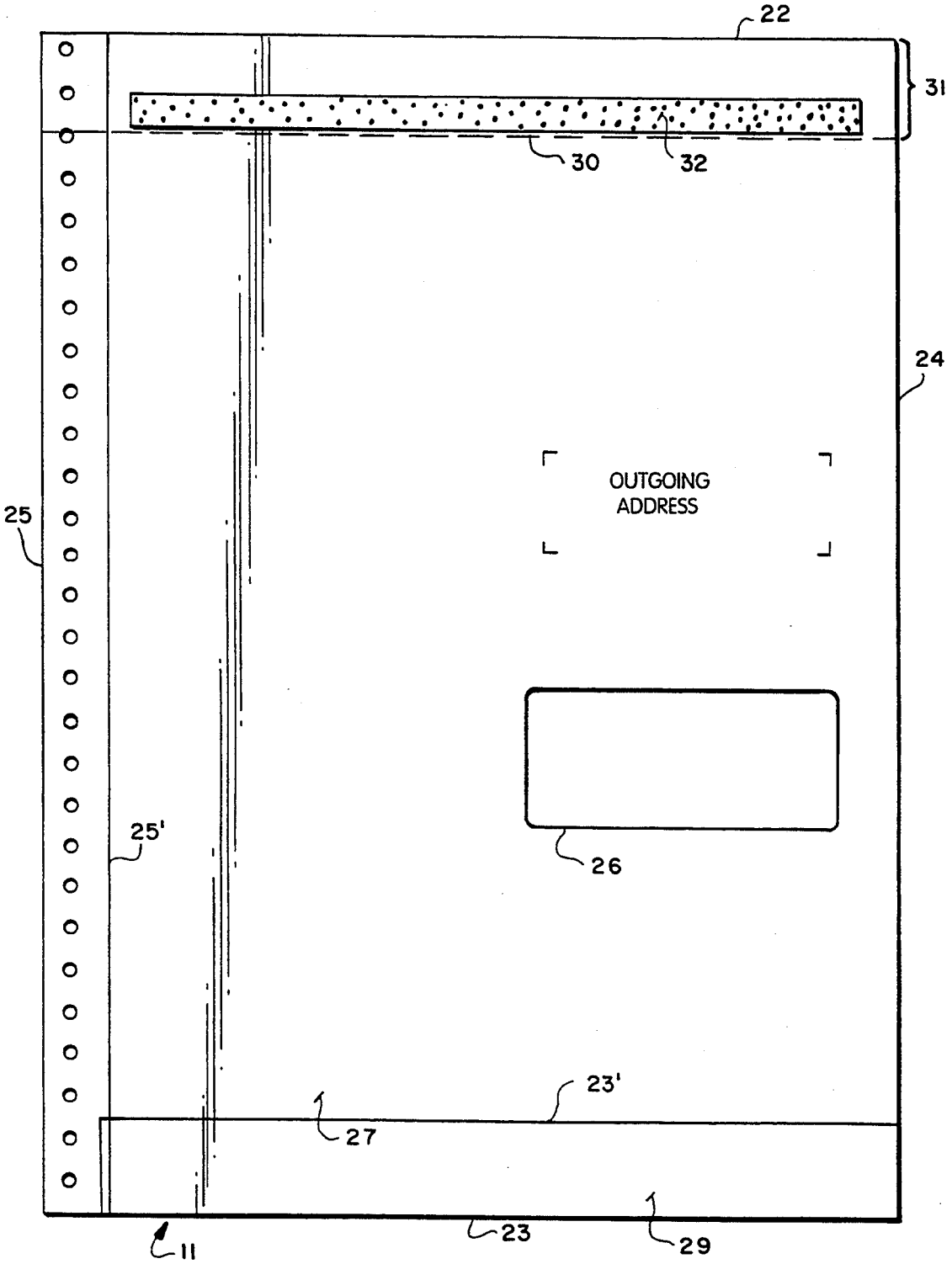
FIG. 1 is a top plan view of a top face of a second ply which is used to form an intermediate for a mailer type business form according to the invention, prior to die cutting of the ply.
Figure 2:
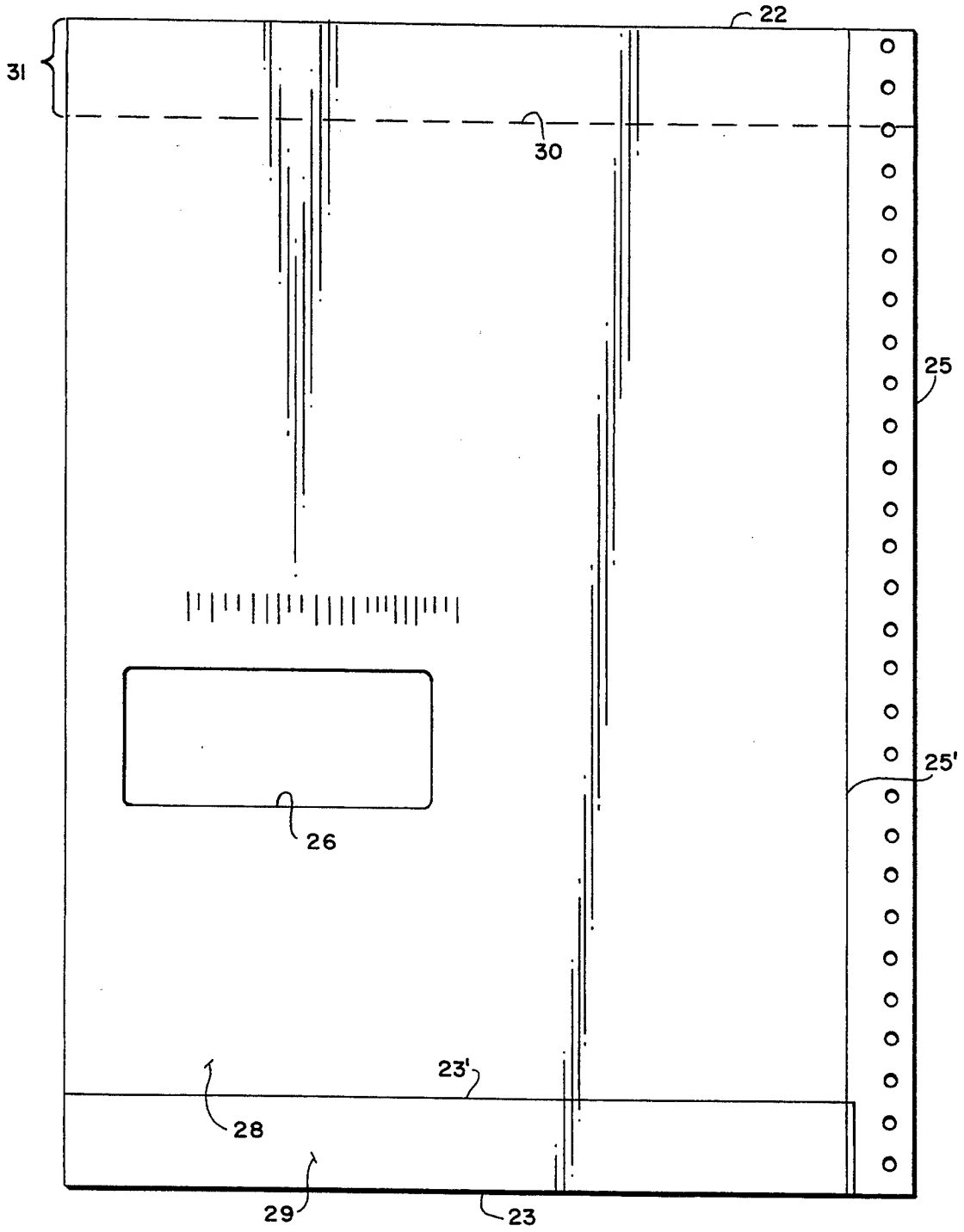
FIG. 2 is a bottom plan view of the ply of FIG. 1.
Figure 3:
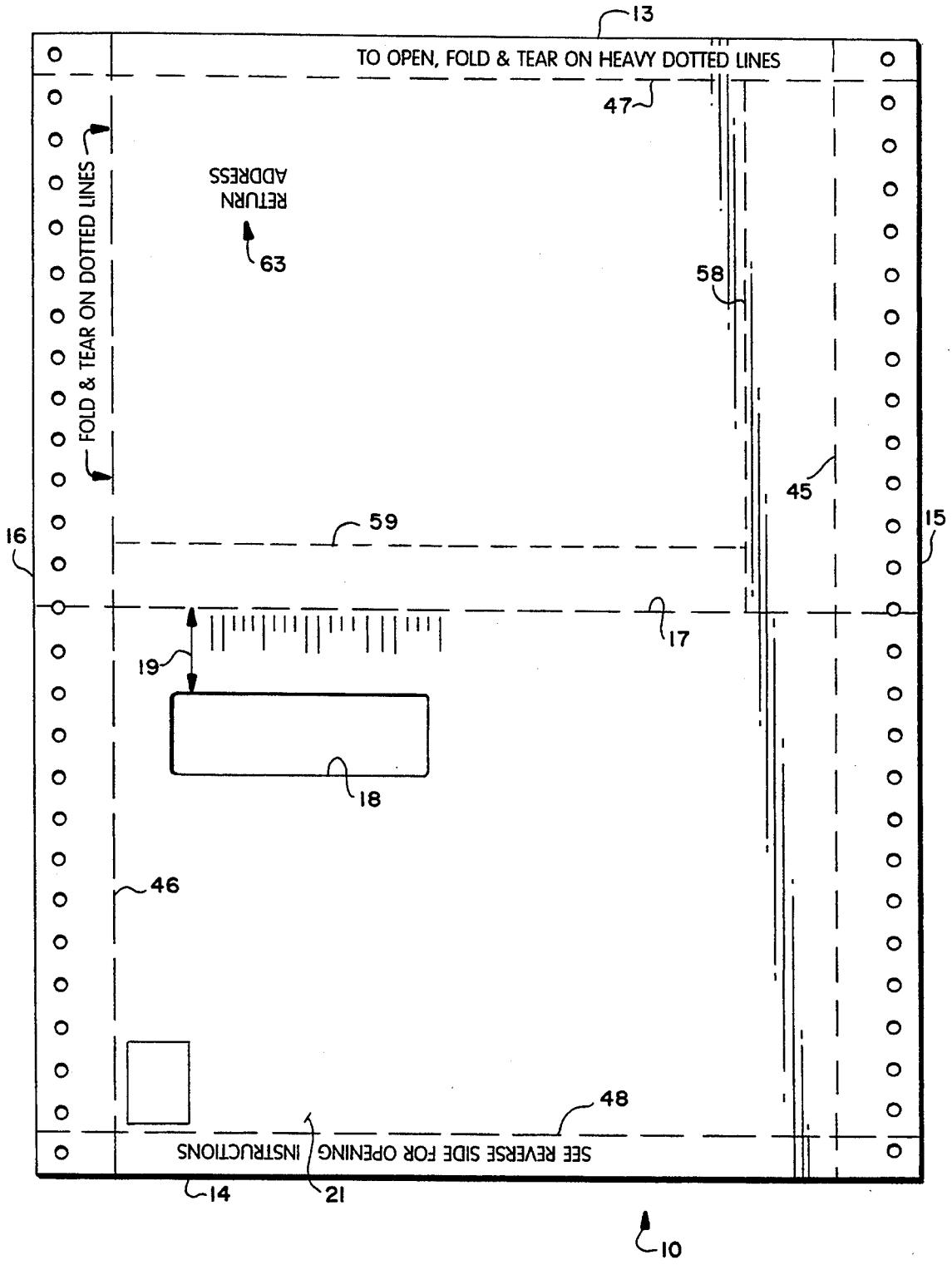
FIG. 3 is a bottom plan view of a first ply which is utilized with the second ply of FIGS. 1 and 2 to construct an intermediate for a mailer type business form.
Figure 4:
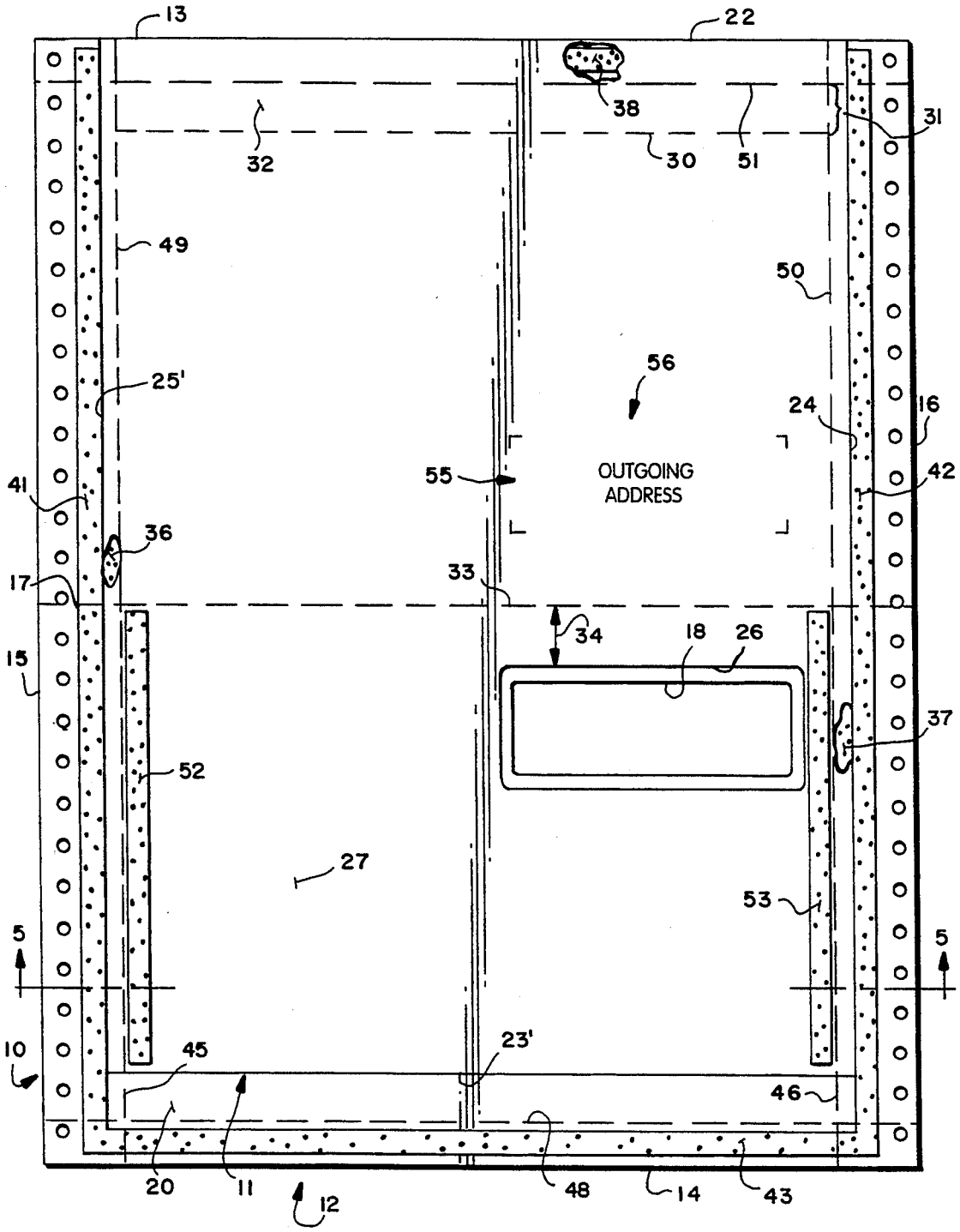
FIG. 4 is a top plan view of the plies of FIGS. 1 through 3 assembled together, after the ply of FIGS. 1 and 2 has been die cut, and held together with adhesive, to form an intermediate.

FIGS. 1 through 4 illustrate a first ply 10 (see FIG. 3) and a second ply 11 (see FIGS. 1 and 2 for the ply 11 before die cutting thereof), the two plies 10, 11 adhesively secured together to form an intermediate for a mailer type business form, shown generally by reference numeral 12 in FIG. 4. The first ply 10 has end edges 13, 14 and side edges 15, 16, having a generally quadrate configuration, with a first width (the length of the edges 13, 14) and a first length (the length of edges 15, 16). A first fold line, which may be a line of weakness such as a perforation line, 17 is provided in the first ply, 10 across the width thereof (that is parallel to the edges 13, 14), preferably bisecting the side edges 15, 16 and perpendicular thereto. The ply 10 is preferably made of paper, and has a window 18 formed therein spaced a predetermined distance 19 from the first fold line 17, which window 18 may or may not have a glassene patch, or other transparent covering. The first ply 10 has a first face 20 (a portion thereof seen in FIG. 4), and a second face 21 (FIG. 3).

At least a portion of the first face 20 preferably is covered with a carbonless coating. For example at least the panel of the first ply 10 between the fold line 17 and bottom 14 has a CF coating on the face 20.

The second ply 11—typically also of paper—originally is constructed as illustrated in FIGS. 1 and 2, having end edges 22, 23 and side edges 24 and 25. The length of the edge 25 is substantially the same as the length of the edges 15, 16, and the length of the edge 22 is substantially the same as the length of the edges 13, 14 minus one tractor drive stub. A window 26 is also formed in the ply 11, and the ply 11 has a first face 27 (FIG. 1) and a second face 28 (FIG. 2).

In construction of the intermediate 12, the second ply 11 is acted upon to reduce the dimensions thereof so that they are significantly less, both in width and length, from the dimensions of the first ply 10, and to provide a fold line. This is accomplished by slitting along the line 25' to form a new side edge, removing the tractor drive openings (on the left hand side in FIG. 1 and right hand side in FIG. 2), and by die cutting out the area 29 to provide a new bottom edge 23'. The face 28 preferably is also coated with carbonless material, i.e. the face 28 contains a CB coating on at least a portion thereof that will cooperate with the CF coating on the face 20 of the first ply 10.

The second ply 11 also has a fold line (e.g. a perforation line or a score line) 30 parallel to and spaced a short distance from the end edge 22, to define the return envelope flap 31. The face 27 of the second ply 11 has an activatable adhesive, such as a rewettable glue strip 32, provided on the flap 31 for sealing the return envelope. Also a second generally central fold line (e.g. perforation or score line) 33 is provided in the second ply 11, spaced the same distance from the edge 22 that the first fold line 17 is spaced from the edge 13, and parallel to the edge 22. The spacing 34 (see FIG. 4) of the second fold line 33 from the second window 26 is only very slightly less than the spacing 19, due to the fact—as illustrated in FIG. 4—that the window 26 has slightly greater dimensions than the window 18 so that when one views the face 21 of the first ply 10 (or intermediate 12 or a final mailer constructed therefrom), no portion of the first ply 11 defining the window 16 is visible.

Figure 5:
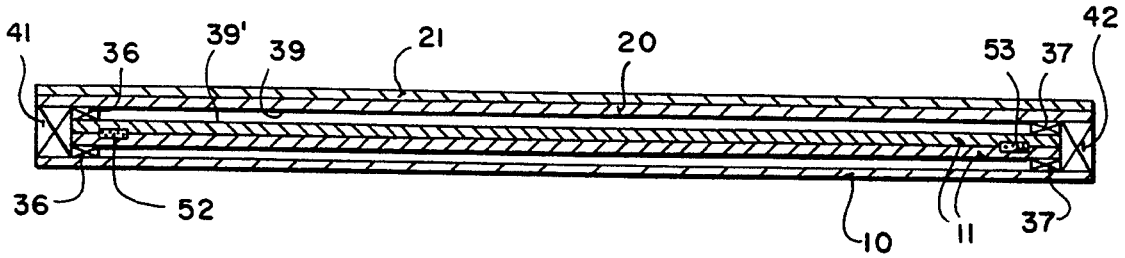
FIG. 5 is a cross-sectional view taken along lines 5—5 of FIG. 4, but after the intermediate of FIG. 4 has been V-folded into a mailer, the components shown greatly exaggerated in thickness for clarity of illustration.

The plies 10, 11 are adhesively secured together to form the intermediate 12. The adhesive patterns utilized for that purpose are shown at 36, 37, and 38 in FIG. 4, being disposed along the edges 22, 24, and 25' of the second face 28 of the first ply 10, and/or on corresponding portions of the first face 20 of the first ply 10. The glue streams 36, 37 are also shown (exaggerated in size) in the cross-sectional view of FIG. 5. Also shown in FIG. 5 is the CF coating 39 on the face 20, and shown at 39' is the CB coating on the face 28. No adhesive is provided adjacent the edge 23' so that it remains free to serve as an edge of the reply envelope formed therefrom.

Figure 6:
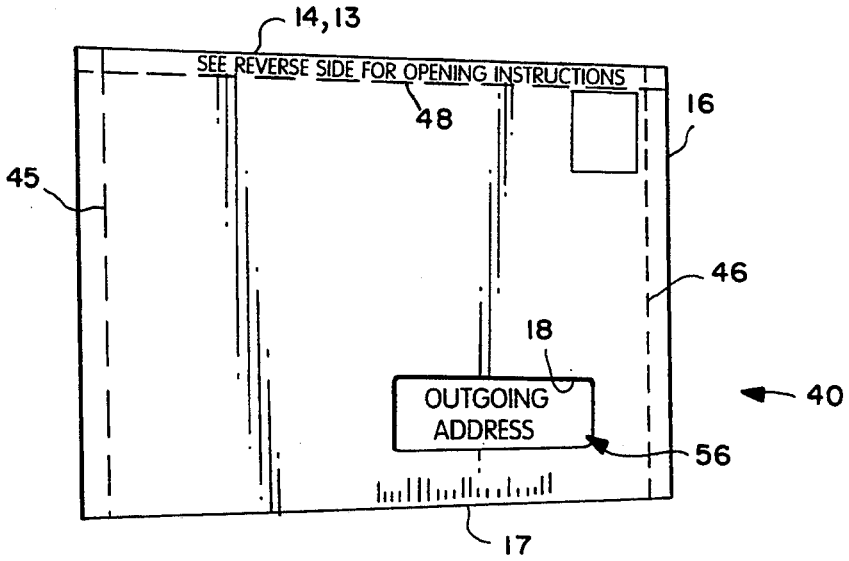
FIG. 6 is a top perspective view of the mailer of FIG. 5.

Additional adhesive patterns are provided to form the intermediate 12 into a mailer, shown generally by reference numeral 40 in FIGS. 5 and 6. These adhesive patterns are seen most clearly in FIG. 4, and comprise the strips 41, 42 that are immediately outside of and adjacent the edges 24, 25' and spaced a short distance from the edges 15, 16, and the strip 43 which is adjacent the edge 14 and spaced a significant distance from the edge 23'. When the intermediate 12 is folded about the fold lines 17, 33, the strips 41–43 seal the ply 10 to itself to form the mailer 40.

In order to facilitate opening up of the mailer 40, perforation lines are provided associated with the various adhesive patterns (strips). For example the perforation lines 45, 46 are provided in the first ply 10 parallel to the edges 15, 16, and just inside the glue strips 36, 37 of the mailer intermediate 12 (that is on the opposite side thereof from the edges 24, 25'). Also provided in the first ply 10 are the perforations 47, 48, parallel to the edges 13, 14, the perforation 47 in the intermediate 12 on the opposite side of the glue strip 38 from the edge 13, and the perforation 48 on the opposite side of the glue strip 43 from the edge 14. Perforations comparable to the perforations 45–47 are also formed in the second ply 11. See the perforation line 49 which is in alignment (registry) with the perforation line 45, the perforation line 50 which is in alignment with the perforation line 46, and the perforation line 51 which is in registry with the perforation line 47.

The intermediate 12 also comprises adhesive patterns to form the second ply 11 into a reply envelope. These adhesive patterns preferably take the form of the strips 52, 53, immediately inside of the perforation lines 49, 50 on the first face 27 of the second ply 11, extending between the second fold line 33 and edge 23'. Note that the distance between the second fold line 33 and the edge 23' is substantially the same as the distance between the second fold line 33 and the fold line 30 for the flap 31.

While the adhesive patterns utilized to construct the intermediate 12 may be of a wide variety of types, it is preferred that they are either heat sealable adhesive or pressure activated cohesive, and permanent glue except for the activatable adhesive 32, which is typically rewettable adhesive or pressure sensitive adhesive covered by a release liner. That is, strips 41 through 43, and 52–53 may be heat sealable adhesive or pressure activated cohesive, while streams 36–38 are non-heat seal glue. Alternatively, the strips 52–53 need not be activated when the intermediate 12 is originally folded into the mailer 40, but rather can be pressure sensitive adhesive covered by release strips so that the reply envelope is formed after the mailer 40 has been opened.

The first face 27 of the second ply 11 also includes an outgoing address area, shown generally by reference numeral 55 in FIG. 4, which ultimately contains outgoing address indicia 56 (see FIGS. 4 and 6). The outgoing address area 55 is spaced substantially the same distance from the second fold line 33, and from the perforation 50, as the window 18 is from the fold line 17 and perforation line 46, so that when the intermediate 12 is folded about the fold lines 17, 33 to form the mailer 40 the outgoing address indicia 56 is visible through the window 18, as seen in FIG. 6.

Figure 7:
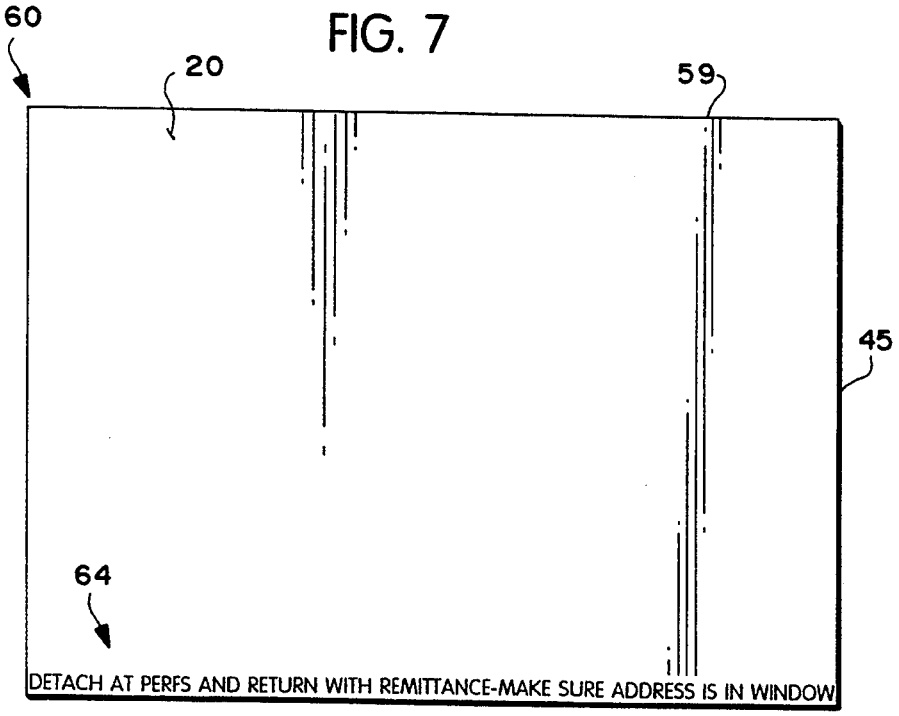

The first ply 10 contains even further perforation lines or lines of weakness which form a reply address containing card. As seen in FIG. 3, perforation lines 58, 59 are formed in the first ply 10 in the panel thereof between the first fold line 17 and the edge 13 thereof, the perforation line 58 parallel to the edges 15, 16, and the perforation line 59 parallel to the edge 13 and the first fold line 17. The perforation lines 46, 47, 58, and 59 define a reply address containing card 60—see FIGS. 7 and 8—which is dimensioned so that it will fit within the reply envelope 61 (see FIGS. 9 and 10) formed from the second ply 11. That is, the dimensions of the card 60 are slightly less than the dimensions between the edge 23' and second fold line 33, and the adhesive strips 52–53, of the second ply 11. Note that the reply address may be printed—as indicated at 63 in FIGS. 3 and 8—on the face 21 of the first ply 10, or alternatively it may be printed on the face 20 (not seen in FIG. 7). On the face of the card 60 opposite the reply address 63, instructional indicia 64 (see FIG. 7) are preferably provided. Note that the reply address 63 indicia—which may include bar coding 65—is spaced a distance 66 from the edge 47 of the card 60 which is substantially the same as the spacing 34, so that when the card 60 is inserted in the reply envelope 61, the reply address indicia 63, 65 is clearly visible through the window 26, as seen in FIG. 10.

In an exemplary manner of construction and use of a mailer 40 according to the invention, the plies 10, 11 are first run on a press for printing, and then on an 85 machine for application of the heat seal adhesive strips 41–43, and 52–53, and formation of the windows 18, 26. The plies 10, 11 are then led to a collator where ply is die-cut and registered with ply 10, so that the fold lines 17, 33 are in alignment as are the windows 18, 26 and the perforation lines 50, 46, and glue streams 30–38 are put on. At this time the stub between the edges 25, 25' is removed (since the tractor drive openings are no longer necessary at this point). The CF and CB coatings 39, 39' are also in face-to-face engagement at this time.

When the intermediate 12 is run through a printer, all data entered on the face 27 where the coatings 39, 39' are provided is transferred to the face 20. If no data is desired on the face 27 in a particular point, but it is desired on the underlying face 20, then a ribbonless printer is used, and a CB spot in the outgoing address area 55. Ultimately, the intermediate 12 is V-folded about the fold lines 17, 33, and then passed through a heat sealer to seal the adhesive strips 41–43 and 52–53, to construct the mailer 40 and reply envelope 61 at the same time. The mailer 40—then having the configuration illustrated in FIG. 6 with the outgoing address 56 visible through the window 18—is then sent to the outgoing addressee.

When the outgoing addressee receives the mailer 40, he/she opens the mailer 40 by tearing along the perforation lines 48, 46–50, 47–51, and 45–49. This provides one sheet, which contains the reply address card 60, and has information printed thereon, and the reply envelope 61. The reply address card 60 is then formed by detachment along perforations 58, 51 from the rest of the remaining first ply 10, and the card 60 is inserted into the open end (adjacent edge 23') of the reply envelope 61 (see FIG. 9) so that the reply address indicia 63, 65 is visible through the window 26 (see FIG. 10). Then the activatable adhesive 32 is activated (e.g. by licking rewettable glue), and the flap 31 is folded about fold line 30 and sealed, as illustrated in FIG. 10. The reply envelope 61 is then ready to be mailed back to the reply addressee.

It will thus be seen that according to the present invention an advantageous intermediate for a mailer type business form, and the mailer produced thereby, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent products and constructions.

What is claimed is:

1. An intermediate for a mailer type business form, comprising:

a first ply having first length and first width dimensions, perimeter edges, first and second faces, and a first window therein;

a first fold line formed in said first ply across the width thereof;

a second ply having second length and second width dimensions both less than said first length and width dimensions, perimeter edges, first and second faces, and a second window therein;

a second fold line formed in said second ply across the width thereof;

first adhesive patterns for attaching said first and second plies together adjacent at least some of said perimeter edges of said second ply, so that said first and second windows are aligned and so that said first and second fold lines are aligned and so that said second ply covers the majority of said first face of said first ply, said second ply second face substantially in face-to-face engagement with said first ply first face;

second adhesive patterns provided adjacent at least some of said perimeter edges of said first face of said first ply on areas thereof uncovered by said second ply, for holding said first ply in an outgoing mailer configuration when folded about said first fold line; and third adhesive patterns formed on said first face of said second ply for forming a reply envelope when said second ply is folded about said second fold line.

2. An intermediate as recited in claim 1 wherein said second window is slightly larger than said first window, and when said windows are aligned no portion of said second ply immediately adjacent said second window is visible through said first window.

3. An intermediate as recited in claim 2 further comprising a CB coating on at least a significant portion of said second face of said second ply, and a CF coating on a portion of said first face of said first ply aligned with said CB coated portion of said second face of said second ply.

4. An intermediate as recited in claim 1 wherein said first adhesive means secures said second ply to said first ply at three perimeter edges of said second ply, but not at a fourth perimeter edge thereof.

5. An intermediate as recited in claim 1 further comprising first lines of weakness disposed adjacent said first adhesive patterns, on the opposite side of at least some of said first adhesive patterns from said second adhesive patterns.

6. An intermediate as recited in claim 5 wherein said second adhesive patterns are disposed adjacent three of said perimeter edges of said first ply, but not adjacent a fourth perimeter edge of said first ply.

7. An intermediate as recited in claim 1 wherein said first fold line is substantially at the mid point of said first length.

8. An intermediate as recited in claim 7 further comprising an outgoing address area provided on said second face of said of second ply spaced the same distance from said second fold line as said second window is from said said second fold line and on the opposite side of said second fold line from said second window.

9. An intermediate as recited in claim 8 further comprising reply address indicia printed on said first ply on the opposite side of said first fold line from said first window.

10. An intermediate as recited in claim 9 wherein said reply address indicia is printed on said second face of said first ply.

11. An intermediate as recited in claim 5 further comprising second lines of weakness for cooperating with said first lines of weakness to facilitate opening of a mailer, formed by said intermediate by folding about said fold lines, into a reply envelope.

12. An intermediate as recited in claim 11 further comprising a flap formed in said second ply remote from said second fold line and on the opposite side of said second fold line from said second window, and activatable adhesive provided on said first face of said second ply at said flap, so that said flap forms the glue flap of a reply envelope when a mailer is constructed from said intermediate.

13. An intermediate for a mailer type business form, comprising:

a first ply having first length and width dimensions, perimeter edges, and first and second faces;

a first fold line formed in said first ply across the width thereof at approximately the mid point of said length;

a second ply having second length and width dimensions both less than said first length and width dimensions, perimeter edges, and first and second faces;

a second fold line formed in said second ply across the width thereof;

first adhesive patterns for attaching said first and second plies together adjacent at least some of said perimeter edges of said second ply, so that said first and second fold lines are aligned and so that said second ply covers the majority of said first face of said first ply, said second ply second face substantially in face-to-face engagement with said first ply first face;

second adhesive patterns provided adjacent at least some of said perimeter edges of said first face of said first ply on areas thereof uncovered by said second ply, for holding said first ply in an outgoing mailer configuration when folded about said first fold line;

third adhesive patterns formed on said first face of said second ply for forming a reply envelope when said second ply is folded about said second fold line;

a CB coating on at least a significant portion of said second face of said second ply; and a CF coating on a portion of said first face of said first ply aligned with said CB coated portion of said second face of said second ply.

14. An intermediate as recited in claim 13 further comprising first lines of weakness disposed adjacent said first adhesive patterns, on the opposite side of at least some of said first adhesive patterns from said second adhesive patterns.

15. An intermediate as recited in claim 14 further comprising second lines of weakness for cooperating with said first lines of weakness to facilitate opening of a mailer formed by said intermediate, by folding about said fold lines, into a reply envelope.

16. An intermediate as recited in claim 15 further comprising a flap formed in said second ply remote from said second fold line and on the opposite side of said second fold line from said second window, and activatable adhesive provided on said first face of said second ply at said flap, so that said flap forms the glue flap of a reply envelope when a mailer is constructed from said intermediate.

17. A mailer type business form comprising:

a first ply having top and bottom faces and a first window therein;

a second ply having top and bottom faces, the top face of said second ply in face-to-face engagement with the bottom face of said first ply, said second ply having a second window therein in alignment with said first window;

a third ply having top and bottom faces underlying said second ply, said third ply top face in substantial face-to-face engagement with said second ply bottom face, and outgoing address information provided on said top face of said third ply in alignment with said first and second windows;

a fourth ply having top and bottom faces, the top face of said fourth ply in substantial face-to-face engagement with said bottom face of said third ply;

adhesive patterns for holding said plies together to form an outgoing mailer configuration, and a reply envelope within said outgoing mailer configuration;

lines of weakness adjacent said adhesive patterns for allowing opening of said outgoing mailer to expose said reply envelope; and reply address indicia printed on said fourth ply, and lines of weakness formed in said fourth ply so that a portion of said fourth ply with said reply address indicia printed thereon may be inserted in said reply envelope.

18. A mailer as recited in claim 17 wherein said second window is slightly larger than said first window, and when said windows are aligned no portion of said second ply immediately adjacent said second window is visible through said first window.

19. A mailer as recited in claim 17 further comprising a CF coating on at least a significant portion of said bottom face of said first ply, and a CB coating on a portion of said top face of said second ply aligned with said CF coated portion of said bottom face of said first ply.

20. A mailer as recited in claim 17 wherein said reply address indicia is printed on the bottom face of said fourth ply on a portion thereof that will be visible through said second window when said portion of said fourth ply with said reply address indicia thereon is inserted into said reply envelope.

21. A mailer as recited in claim 17 further comprising a reply envelope flap formed in said third ply, and activatable adhesive on said top face of said third ply at said flap.

22. A mailer type business form comprising:

a first ply having top and bottom faces;

a second ply having top and bottom faces, the top face of said second ply in face-to-face engagement with the bottom face of said first ply;

a third ply having top and bottom faces underlying said second ply, said third ply top face in substantial face-to-face engagement with said second ply bottom face, and outgoing address information provided on said top face of said third ply;

a fourth ply having top and bottom faces, the top face of said fourth ply in substantial face-to-face engagement with said bottom face of said third ply;

adhesive patterns for holding said plies together to form an outgoing mailer configuration, and a reply envelope within said outgoing mailer configuration;

first lines of weakness adjacent said adhesive patterns for allowing opening of said outgoing mailer to expose said reply envelope;

a CF coating on at least a significant portion of said bottom face of said first ply, and a CB coating on a portion of said top face of second ply aligned with said CF coated portion of said bottom face of said first ply; and reply address indicia printed on said fourth ply, and second lines of weakness formed in said fourth ply so that a portion of said fourth ply with said reply address indicia printed thereon may be inserted in said reply envelope.

23. A mailer as recited in claim 22 further comprising a return envelope flap formed in said third ply, and activatable adhesive on said top face of said third ply at said flap.

* * * * *